137-13
4/7/81 OR 4,259,977

United States Patent [19]
Brockington

[11] 4,259,977
[45] Apr. 7, 1981

[54] TRANSPORTATION AND PLACEMENT OF WATER-IN-OIL EMULSION EXPLOSIVES AND BLASTING AGENTS

[75] Inventor: James W. Brockington, Allentown, Pa.

[73] Assignee: Atlas Powder Company, Dallas, Tex.

[21] Appl. No.: 30,426

[22] Filed: Apr. 16, 1979

[51] Int. Cl.[3] ..... F17D 1/16
[52] U.S. Cl. ..... 137/13; 137/896
[58] Field of Search ..... 137/13, 1, 604; 149/108.8; 166/299

[56] References Cited

U.S. PATENT DOCUMENTS

| | | | |
|---|---|---|---|
| 2,821,205 | 1/1958 | Chelton | 137/13 |
| 3,066,733 | 12/1962 | Brandon | 166/299 |
| 3,414,004 | 12/1968 | Bankston | 137/13 X |
| 3,456,589 | 7/1969 | Thomison | 166/299 UX |
| 3,977,469 | 8/1976 | Broussard | 137/13 X |

*Primary Examiner*—Alan Cohan

[57] ABSTRACT

Disclosed is a method of pumping and preventing plugging for water-in-oil emulsion explosives within conduits in which the pumping is interrupted and a lubricating fluid is used that moves in an annular stream around the emulsion. The lubricating fluid provided by the invention which comprises an aqueous salt solution allows interruption of the pumping without the occurrence of plugging in the conduit.

19 Claims, 3 Drawing Figures

TRANSPORTATION AND PLACEMENT OF WATER-IN-OIL EMULSION EXPLOSIVES AND BLASTING AGENTS

BACKGROUND OF THE INVENTION

In one aspect this invention relates to the transportation of water-in-oil emulsion explosives. In another aspect, this invention relates to an improved method of pumping water-in-oil emulsion explosives where the flow is stopped at least once. In still another aspect this invention relates to placement of water-in-oil emulsion explosives.

Water-in-oil emulsion explosives were first disclosed by Bluhm in U.S. Pat. No. 3,447,978. Emulsion explosives normally comprise at least one inorganic oxidizer salt, a carbonaceous fuel, water, oil and an emulsifier. Various other materials, including sensitizing agents and additional fuels, can be employed in a variety of formulations.

The explosives industry has for many years been concerned with the transportation and placement of liquid emulsion type explosives. For example, it is often desirable to pump the emulsion through a hose or pipe into a borehole. Use of emulsion type explosives can be very advantageous. Such explosives are low in cost, high in explosive power and water resistant, making them excellent for general use, especially where underground water is present. Another advantageous property of water-in-oil emulsion explosives is their high viscosity making them resistant to gravity flow. Thus, these emulsions can be used and will stay in position in boreholes that are either horizontal or vertical in inclination. However, emulsion explosives under certain conditions are difficult to pump. Naturally, it would be expected that a fluid of high viscosity, resistant to gravity flow, would have poor pumpability. To facilitate pumping of these emulsions, a pumping method was devised in which water, introduced by a spray ring in an annular stream around the emulsion, flows in the same direction as the emulsion. This method greatly reduces flow resistance of the emulsion and thereby results in reduced pressure requirements. However, often times the pumping operation cannot be stopped or interrupted without the ccurrence of plugging. For example, if the flow is interrupted and the emulsion is allowed to stand in the hose or conduit for more than about 15–20 minutes, the emulsion will swell and plug the delivery hose. Thus, under these conditions, the emulsion often becomes immovable at normal pumping pressures. In the past, it was necessary for the delivery hoses to be flushed out when the pumping operation was stopped overnight, for example. The swelling resulting from contact of the emulsion with the water lubricating film may adversely affect and desensitize the explosive. Accordingly, to fully benefit from the advantages of these explosives, a method was required to overcome the difficulties in transporting and pumping which are presented by the inherent physical properties of these emulsions.

SUMMARY OF THE INVENTION

According to the invention an improved method of transporting and pumping water-in-oil explosive emulsions through conduits with lubricating fluids is provided in which the flow can be interrupted and restarted without greatly increasing pressure or without plugging occurring which comprises the use of a lubricating fluid that is an aqueous salt solution. The salt used in the lubricating fluid is preferably a salt which is contained within the emulsion and is generally present in an amount in the range of from about 20% to about 65% by weight of the lubricating fluid. The pumping operation can then be interrupted for hours and restarted without plugging occurring and without the need for increasing pumping pressure over practical limits. The lubricating fluid is used such that it flows in an annular stream around the emulsion at substantially the same velocity as the emulsion. The annular ring which comprises the lubricating fluid can be formed by use of a spray ring apparatus which allows the lubricating fluid to be introduced to the conduit at a specific flow rate around the emulsion.

BRIEF DESCRIPTION OF THE DRAWINGS

The method of the subject invention can be more easily understood by reference to the following drawings in which.

DETAILED DESCRIPTION OF THE INVENTION

The improved method of this invention permits the pumping operation of water-in-oil emulsion explosives to be stopped and started at least once during the pumping operation without plugging occurring and without the need for an impractical increase in pump discharge pressure. Normally, pumping will be employed when it is desired to transport the explosive emulsion into boreholes and similar detonation sites. The improved method of this invention comprises an aqueous salt solution lubricating fluid in a pumping system where the lubricating fluid forms an annular ring around the explosive emulsion and the lubricating fluid and the explosive emulsion have substantially the same velocity. This flow configuration can be achieved through the use of a spray ring to introduce the lubricating fluid into the conduit. In order to minimize flow resistance and avoid desensitization of the emulsion explosive, lubricating fluid flow rates of from about 3% to about 5% of the explosive flow rate on a weight basis have been found to be the most effective. The proper flow rate of lubricating fluid relative to the flow rate of the explosive is important, since too much lubricating fluid can desensitize the explosive and not enough lubricating fluid will prevent the full realization of the benefits of the invention.

Figure 2:
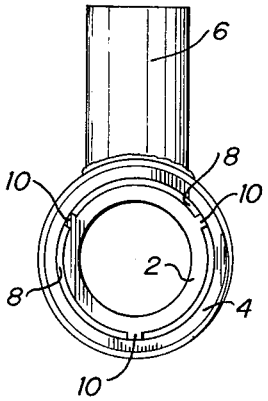
FIG. 2 is an end view of the spray ring apparatus of FIG. 1.
Figure 1:
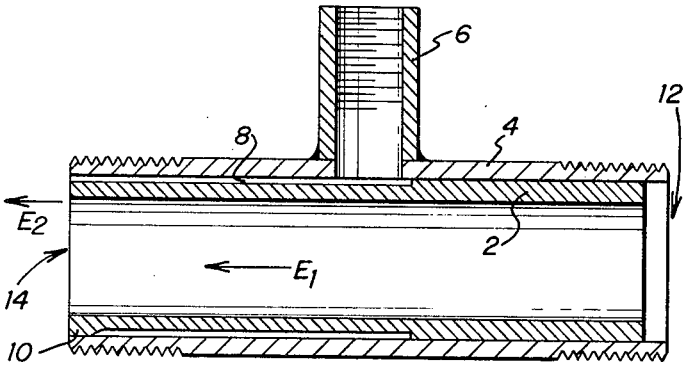
FIG. 1 is a cross sectional view of the spray ring apparatus useful in the practice of the present invention.

Referring to FIGS. 1 and 2, a cross sectional configuration (FIG. 1) and an end view (FIG. 2) of a spray ring apparatus useful in the formation of an annular ring of lubricating fluid about an axial flow of emulsion explosive through a conduit is shown. Thus, the spray ring apparatus basically comprises explosive emulsion conduit 2 contained annularly within lubricating fluid conduit 4 to which lubricating fluid injection conduit 6 is welded in a communicating fashion. Film forming annular space 8 is provided between lubricating fluid conduit 4 and the explosive emulsion conduit 2 in a fashion such that the lubricating fluid entering via injection conduit 6 is distributed substantially evenly in an annular flow pattern around the explosive emulsion exiting from conduit 2. Even spacing can be provided by spacer legs 10 spaced substantially equidistant around the outlet end of annular space 8. Thus, an emulsion explosive can be pumped into inlet end 12 of explosive emulsion conduit 2 and as it exits outlet end 14 thereof a lubricating fluid in accordance with the invention is introduced in an annular manner via injection conduit 6 and annular space 8. In this manner an annular film of lubricating fluid is formed substantially continuously around the axial flow of emulsion explosive composition. A delivery conduit substantially the same in interior diameter as lubricating fluid conduit 4 is used to transport the emulsion and lubricating fluid to the site of use.

It should be noted that linear velocities should be employed to ensure that the annular ring of lubricating fluid remains essentially distinct from the explosive composition, and that mixing of the explosive emulsion and lubricating fluid is minimized. Thus, laminar flow is desired and any turbulent intermixing should be avoided to derive maximum benefit from the invention. Thus, it is important when calculating the precise measurements for emulsion conduit 2 and lubricating fluid conduit 4 and the annular space 8, therebetween, to take into account the linear velocities of the lubricating fluid and emulsion explosive exiting from outlet end 14 of the spray ring apparatus. By insuring that the flow rates and geometry of the spray ring are such that the linear velocities of the lubricating fluid are preferably matched to the velocity of the emulsion so that turbulent intermixing of the two components can be avoided. The velocity of the lubricating fluid should always be kept within from about 50% less to about 50% greater than the velocity of the emulsion as it enters lubricating conduit 4 in order to avoid the problems turbulence can cause. Thus, the difference in velocities of the emulsion traveling through emulsion conduit 2 (represented by arrow $E_1$) and that of the emulsion as it exits therefrom (represented by arrow $E_2$) must be taken into account. This can be accomplished by increasing the size of annular space 8, thus reducing the linear velocity of the lubricating fluid at the preferred flow rates of from about 3 to about 5 percent by weight, based on the weight flow rate of the emulsion explosive.

Figure 3:
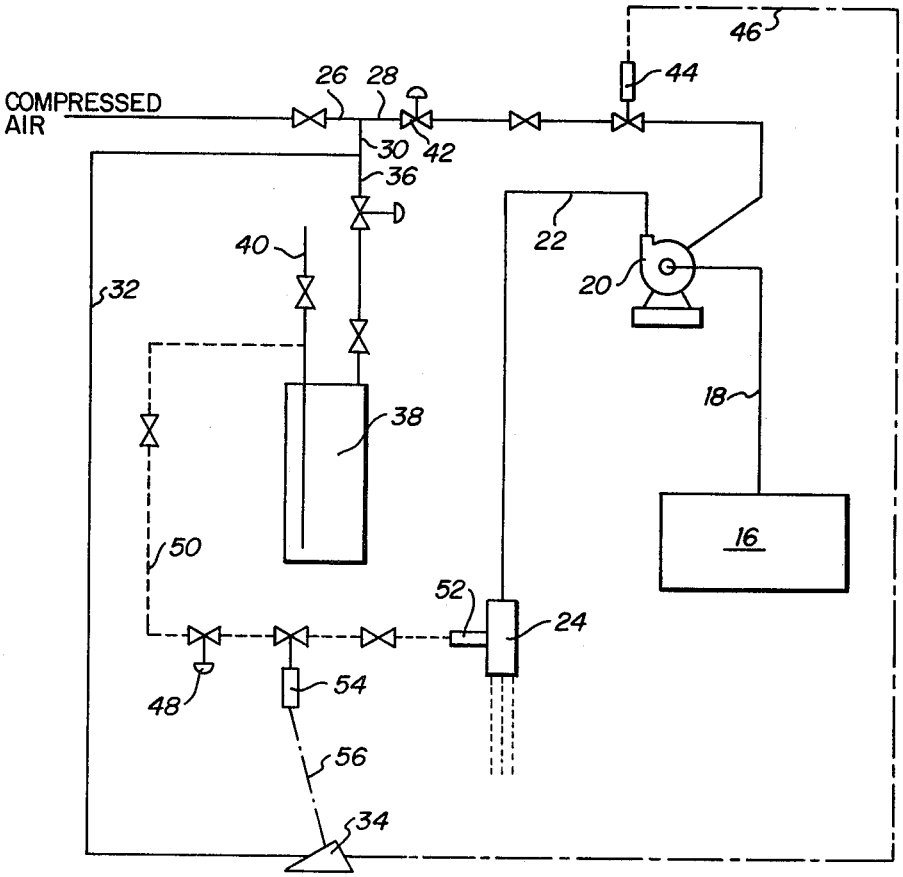
FIG. 3 is a schematic representation of a pumping and control apparatus useful in the method of the subject invention.

Now referring to FIG. 3, a schematic representation of one system which can be employed to practice the process of the subject invention is shown. Basically, the system comprises a holding tank or hopper 16 of explosive emulsion with a feed conduit 18 entering inlet side of pumping means 20. Outlet conduit 22 provides for the transportation of emulsion explosive to a spray ring apparatus 24, such as that described with relation to FIGS. 1 and 2. A compressed air supply is attached to conduit 26 so as to supply pressurized air to conduits 28 and 30. Conduit 30 supplies air to foot pedal valve 34 via conduit 32. Conduit 30 also supplies pressurized air to lubricating fluid holding tank 38 via conduit 36.

Air pressure in conduit 28 is controlled by pressure valve 42, thus controlling the amount of air pressure delivered to pumping means 20 and thereby controlling the pumping rate thereof. Valve means 44, which can be a solenoid valve for example, is interconnected via air control line 46 to foot pedal valve 34. In a similar manner, the flow of lubricating fluid to spray ring apparatus 24 is controlled via needle valve 48 located along lubricating fluid supply line 50. The flow of lubricating fluid into the lubricating fluid inlet 52 of spray ring 24 is controlled by air controlled solenoid valve 54 which is interconnected with foot pedal valve 34 via air control line 56.

Thus, by setting needle valve 48 and pressure valve 42, the rate of flow of the emulsion explosive and lubricating fluid delivered to spray ring 24 can be controlled so as to keep the ratio of flow rates within the preferred 3 to 5 weight percent range. As set forth above, the cross sectional areas of the spray ring apparatus can be adjusted so as to provide the substantially matched linear velocity of lubricating film and explosive emulsion discussed above. The interconnection of the lubricating fluid source to the air line servicing the pumping means provides for simple operation whereby the operator can have his hands free to perform other functions during loading of explosive compositions.

Typical pumpable water-in-oil emulsion explosive compositions are basically comprised of a continuous hydrocarbon fuel phase with a discontinuous aqueous oxidizer solution phase contained therein. Thus, for example, an explosive emulsion having from about 40 to about 75 percent by weight inorganic oxidizing salts (such as mixtures of ammonium nitrate, sodium nitrate and ammonium perchlorate, for example), water, in a range of from about 10 to about 25 percent, mineral oils and waxes in a range of from about 5 to about 10 percent and various other fuels and sensitizing agents such as glass microspheres, can be employed. Some typical emulsion explosive compositions of this type are described in Bluhm, U.S. Pat. No. 3,447,978 and in Wade, U.S. Pat. No. 4,110,134.

The lubricating fluid basically comprises an aqueous salt solution, usually having a salt concentration of from about 20% to about 65% by weight thereof. Any aqueous salt solution can be employed as the lubricating fluid as long as it is compatible with the particular emulsion being pumped, so that desensitization of the explosive does not occur. More than one type of salt can be present in the lubricating fluid.

The preferred embodiment of this invention is the use of an aqueous salt solution as the lubricating fluid where the salt corresponds to the major salt present in the emulsion. Generally, when the concentration of the salt in the lubricating fluid is equal to the salt concentration in the emulsion, the benefits of this invention are maximized. The concentration of the salt in the lubricating fluid should not be greater than the maximum solubility of the salt in the aqueous lubricating fluid. Effective results can be obtained using salt concentrations which are significantly less than the concentration of the salt present in the explosive emulsion, and economic considerations may favor the use of lower salt concentrations in the lubricating fluid. Further, in some situations, because of the limited solubility of the salt in water, the salt concentration in the lubricating fluid will necessarily be less than the salt concentration in the emulsion.

Thus, in a typical emulsion formulation where ammonium nitrate is the primary salt, an aqueous solution of ammonium nitrate is the preferred lubricating fluid. Usually a salt concentration range of from about 30% to about 55% by weight of lubricating fluid would be employed.

The aforesaid formulations of the lubricating fluid allow the annular ring of lubricating fluid to retain its integrity for a much longer period of time than, for example, a lubricating fluid consisting of water. It is believed that the lubricating film retains its integrity because in the absence of a concentration gradient between the lubricating film and the discontinuous aqueous phase of the explosive emulsion, no mass transfer will occur, and therefore, the integrity of the lubricating film will be retained. Where there is a concentration gradient between the aqueous phase and the lubricating fluid, the mass transfer from the spray ring to the aqueous phase of the explosive will cause the lubricating film to lose its integrity and the emulsion to swell after a period of time, thereby causing any benefit of using lubricating fluid to be lost. Thus, where the flow of explosive emulsion is stopped for a sufficient length of time for mass transfer to occur between the water lubricating fluid and the emulsion, pressures needed to restart the flow can become impractically high. By increasing the salt concentration in the lubricating fluid to as close to that of the aqueous phase of the explosive emulsion as is practical, mass transfer between the two fluids is minimized, thereby permitting the flow to remain stopped for a substantial length of time while retaining the integrity of the explosive emulsion and lubricating fluid. According to the invention, the flow can be restarted after being stopped for 18 hours, as set forth in the subsequent example.

For example, when an explosive emulsion comprising ammonium nitrate as the primary oxidizing salt is to be transported through a conduit, use of an aqueous ammonium nitrate solution as the lubricating fluid in concentrations of from about 20% to 65% by weight thereof permits the explosive or blasting agent emulsions to remain in a static condition in a conduit, hose or pipe without the emulsion absorbing significant quantities of the lubricating fluid, so that the expansion or swelling of the emulsion is kept at a minimum. Upon resuming the pumping operation, no substantial plugging or increased pressure requirements are encountered.

EXAMPLE

This example is set forth for the purpose of exemplifying the embodiment of the present invention wherein a lubricating fluid consisting of an aqueous solution of ammonium nitrate is employed so that the explosive emulsion can be pumped through a hose in which it has been allowed to reach a steady state for a significant period of time. The emulsion explosive used in this example had the following formula:

| Component | Weight Percent |
|---|---|
| Ammonium Nitrate | 54.7 |
| Sodium Nitrate | 9.7 |
| Ammonium Perchlorate | 7.3 |
| Oil (type Mineral) | 4.5 |
| Emulsifier (type Sorbitan Ester) | 1.5 |
| Glass Microspheres (type 3m Co.) | 2.0 |
| Water | 19.3 |

The emulsion explosive was pumped into a one inch inside diameter hose 75 feet in length. The flow rate of the lubricating fluid was approximately 4.7 to about 4.8 percent by weight based upon the flow rate of the explosive emulsion. In order to compare the effect of employing an aqueous solution of ammonium nitrate to the results obtained when employing water alone, 30 percent aqueous ammonium nitrate solutions and 50 percent aqueous ammonium nitrate solutions were employed as the lubricating fluid, as well as water. The results of the pumping tests are set forth below in Table 1.

TABLE 1

| Lubricating Fluid Composition: | Water | Water | 50% AN | 30% AN | 30% AN |
|---|---|---|---|---|---|
| Pumping Stopped For: | 15 min. | 30 min. | 1.5 hr. | 4.0 hr. | 18.0 hr. |
| Hose Plugged at Pump Discharge Pressure of: | | | | | |
| 75-80 psi | Yes | Yes | No | No | Yes |
| 100 psi | — | Yes | — | — | No |
| 125 psi | — | Yes | — | — | — |

Thus, after 30 minutes of downtime the hoses remained plugged at pressure up to 125 psi when water was employed as the lubricating fluid. However, after a four hour downtime period the same emulsion could be pumped through the same hose at pressures of less than 75–80 psi when the 30% ammonium nitrate solution was employed as a lubricating fluid.

Although various embodiments of the invention will now be apparent to those skilled in the art, it will be understood that the invention is not limited to the embodiments disclosed and substitutions and modifications may be made without departing from the spirit of the invention.

I claim:

1. An improved method of pumping water-in-oil explosive emulsions within a conduit with a lubricating fluid moving as an annular stream around said explosive where the pumping is stopped and restarted, which comprises providing as said lubricating fluid an aqueous salt solution.

2. An improved method of pumping water-in-oil explosive emulsions within a conduit with a lubricating fluid moving as an annular stream around said explosive where the pumping is stopped and restarted, which comprises providing as said lubricating fluid an aqueous salt solution wherein the salt of said lubricating fluid corresponds to the major salt present in the explosive emulsion.

3. The improved method as recited in claim 1 wherein the interruption of said pumping is of a duration of more than about 15 minutes.

4. The improved method as recited in claim 1 wherein the interruption of said pumping is of a duration of more than 30 minutes.

5. The improved method as recited in claim 1 wherein the interruption in pumping is a duration of more than 8 hours.

6. The improved method as recited in claim 1 wherein the concentration of said salt in said lubricating fluid is from about 20% to about 65% by weight thereof.

7. An improved method of pumping water-in-oil explosive emulsions within a conduit with a lubricating fluid moving as an annular stream around said explosive where the pumping is stopped and restarted, which comprises providing as said lubricating fluid an aqueous ammonium nitrate solution present in said lubricating fluid in an amount between about 20% and about 65% by weight thereof.

8. The improved method as recited in claim 2 wherein the concentration of the salt in said lubricating fluid is essentially the lesser of the concentration of the major salt in the discontinuous phase of the explosive emulsion and the maximum solubility of the salt in said aqueous solution.

9. The improved method as recited in claim 1 wherein more than one salt is present in said lubricating fluid.

10. A method of preventing plugging in the pumping of water-in-oil emulsion explosives within a conduit with a lubricating fluid moving as an annular stream around said explosive where the pumping is interrupted and restarted, which comprises providing an aqueous salt solution as said lubricating fluid to thereby inhibit swelling of said emulsion and maintain the integrity of the lubricating fluid.

11. A method of preventing plugging in the pumping of water-in-oil emulsion explosives within a conduit with a lubricating fluid moving as an annular stream around said explosive where the pumping is interrupted and restarted, which comprises providing an aqueous salt solution as said lubricating fluid to thereby inhibit swelling of said emulsion and maintain the integrity of the lubricating fluid wherein the salt of said lubricating fluid corresponds to the major salt present in the emulsion explosive.

12. The method as recited in claim 10 wherein the interruption of said pumping is of a duration of more than about 15 minutes.

13. The method as recited in claim 10 wherein the interruption of said pumping is of a duration of more than about 30 minutes.

14. The method as recited in claim 10 wherein the interruption of said pumping is of a duration of more than 8 hours.

15. The method as recited in claim 10 wherein the aqueous salt solution contains from about 20% to about 65% salt by weight thereof.

16. A method of preventing plugging in the pumping of water-in-oil emulsion explosives within a conduit with a lubricating fluid moving as an annular stream around said explosive where the pumping is interrupted and restarted, which comprises providing an aqueous salt solution as said lubricating fluid to thereby inhibit swelling of said emulsion and maintain the integrity of the lubricating fluid wherein the salt in said lubricating fluid is ammonium nitrate.

17. The method as recited in claim 16 wherein the concentration of ammonium nitrate in said lubricating fluid is from about 20% to about 65% by weight thereof.

18. The method as recited in claim 11 wherein the concentration of salt in the lubricating fluid is essentially the lesser of the major salt concentration in the discontinuous phase of the explosive emulsion and the maximum solubility of the salt in said aqueous solution.

19. The method as recited in claim 10 wherein more than one salt is present in said lubricating fluid.

* * * * *